US006286918B1

(12) United States Patent
King

(10) Patent No.: US 6,286,918 B1
(45) Date of Patent: Sep. 11, 2001

(54) FRAMELESS CABINET HINGE SYSTEM

(76) Inventor: Ron E. King, 1545 River Park Dr., Suite 450, Sacramento, CA (US) 95815

( * ) Notice: Subject to any disclaimer, the term of this patent is extended or adjusted under 35 U.S.C. 154(b) by 0 days.

(21) Appl. No.: 09/542,439

(22) Filed: Apr. 4, 2000

Related U.S. Application Data

(60) Provisional application No. 60/129,101, filed on Apr. 13, 1999.

(51) Int. Cl.[7] ..... A47B 96/07

(52) U.S. Cl. ..... 312/326; 16/382

(58) Field of Search ..... 16/271, 272, 261, 16/264, 382; 312/326, 327, 328, 329

(56) References Cited

U.S. PATENT DOCUMENTS

| | | | | |
|---|---|---|---|---|
| Re. 30,717 | | 8/1981 | Dargene . | |
| Re. 36,213 | | 6/1999 | Lautenschläger, Jr. et al. . | |
| 3,524,216 | * | 8/1970 | Fernandez et al. | 16/382 X |
| 4,517,706 | | 5/1985 | Lautenschläger et al. . | |
| 4,615,072 | | 10/1986 | Lautenschläger, Jr. et al. . | |
| 4,698,877 | | 10/1987 | Lautenschläger, Jr. et al. . | |
| 4,703,539 | | 11/1987 | Lautenschläger, Jr. et al. . | |
| 4,704,766 | | 11/1987 | Almestad . | |
| 4,799,290 | | 1/1989 | Lautenschläger, Jr. et al. . | |
| 4,856,141 | | 8/1989 | Sassenberg . | |
| 4,976,006 | | 12/1990 | Lautenschläger . | |
| 5,052,077 | | 10/1991 | Lautenschläger, Jr. et al. . | |
| 5,067,200 | | 11/1991 | Stowell et al. . | |
| 5,103,532 | | 4/1992 | Youngdale et al. . | |
| 5,108,165 | | 4/1992 | Rorke et al. . | |
| 5,327,616 | | 7/1994 | Lautenschläger, Jr. et al. . | |
| 5,375,297 | | 12/1994 | Lautenschläger, Jr. et al. . | |
| 5,392,493 | | 2/1995 | Youngdale . | |
| 5,511,287 | | 4/1996 | Lautenschläger, Jr. et al. . | |
| 5,577,296 | | 11/1996 | Grass . | |
| 6,163,930 | * | 12/2000 | King | 16/382 |

FOREIGN PATENT DOCUMENTS

4405349A1 8/1998 (DE) .

OTHER PUBLICATIONS

Charles McMurray Catalog pp. 93 and 112–114.

* cited by examiner

*Primary Examiner*—Peter M. Cuomo
*Assistant Examiner*—Michael J. Fisher
(74) *Attorney, Agent, or Firm*—Thomas R. Lampe

(57) ABSTRACT

Apparatus for installing a cabinet door on a wall of a cabinet of frameless construction includes an elongated support plate positionable in an elongated recess of the wall, the support plate having an elongated aperture. A hinge member is releasably secured to the support plate by a mechanical fastener extending into the recess and into the elongated aperture of the support plate through an elongated slot formed in the cabinet wall.

14 Claims, 2 Drawing Sheets

FRAMELESS CABINET HINGE SYSTEM

This application is based on and claims the benefit of U.S. Provisional Application No. 60/129,101, filed Apr. 13, 1999.

TECHNICAL FIELD

This invention relates to a hidden hinge system employed with cabinets of frameless construction to attach a cabinet door to a cabinet wall.

BACKGROUND OF THE INVENTION

There are many types of cabinet hinges, including cabinet hinges employed in cabinets of so-called frameless construction, i.e., cabinets lacking a face frame.

The following prior art is known and believed representative of the current state of the prior art: U.S. Pat. No. 5,067,200, issued Nov. 26, 1991, U.S. Pat. No. 4,703,539, issued Nov. 3, 1987, U.S. Pat. No. 5,511,287, issued Apr. 30, 1996, U.S. Pat. No. 4,799,290, issued Jan. 24, 1989, U.S. Pat. No. 4,856,141, issued Aug. 15, 1989, U.S. Pat. No. 5,327,616, issued Jul. 12, 1994, U.S. Pat. No. 5,375,297, issued Dec. 27, 1994, U.S. Pat. No. 5,108,165, issued Apr. 28, 1992, U.S. Pat. No. RE.36,213, issued Jun. 1, 1999, U.S. Pat. No. RE.30,717, issued Aug. 25, 1981, U.S. Pat. No. 5,052,077, issued Oct. 1, 1991, U.S. Pat. No. 4,615,072, issued Oct. 7, 1986, U.S. Pat. No. 4,517,706, issued May 21, 1985, U.S. Pat. No. 4,698,877, issued Oct. 13, 1987, U.S. Pat. No. 5,392,493, issued Feb. 28, 1995, U.S. Pat. No. 5,577,296, issued Nov. 26, 1996, U.S. Pat. No. 5,103,532, issued Apr. 14, 1992, U.S. Pat. No. 4,704,766, issued Nov. 10, 1987, and U.S. Pat. No. 4,976,006, issued Dec. 11, 1990. A frameless cabinet door hinge is closed in German Offenlegungsschrift DE 4405349A1. Other hinges of some degree of relevance are shown in pages 93 and 112–114 of the 1998 Charles McMurray Catalog.

The hinge systems disclosed in the above-identified prior art do not incorporate the structural combinations disclosed and claimed herein.

DISCLOSURE OF INVENTION

The present invention relates to a hidden hinge system which is particularly applicable to attaching cabinet doors to walls of frameless cabinets. The invention is characterized by its ease of use and also by its superior strength characteristics. Most notably, the hinge system and cabinet wall to which it is applied can withstand the application of large forces without failure when the hinge is bent back from a maximum normal open position. Forces from the hinge are distributed over a large area of the cabinet wall, allowing frameless cabinets incorporating doors to be constructed using less material than otherwise would be the case.

Another advantage of the present invention is the fact that a range of adjustment is provided, allowing the structure to be utilized with components and materials of differing sizes and types. The teachings of the invention can be applied to a variety of hinge constructions from different manufacturers and of differing sizes. This adjustability feature also simplifies and facilitates installation.

The hinge system of the present invention is utilized with a cabinet of frameless construction, the cabinet including a cabinet wall and a cabinet door. The cabinet wall includes spaced wall sides and a wall front extending between the spaced wall sides. The cabinet wall defines an opening at the wall front, an elongated recess extending inwardly from the opening into the cabinet wall between the wall sides and an elongated slot in one of the wall sides communicating with the elongated recess.

The elongated slot has a vertical dimension less than the vertical dimension of the elongated recess and it is located at an elevation below the uppermost extent of the elongated recess and above the lowermost extent of the elongated recess.

A double-ended elongated support plate is located within the elongated recess with one of the ends of the elongated support plate disposed at or closely adjacent to the opening in the wall front of the cabinet wall and the other end located a predetermined distance inwardly of the opening.

The elongated support plate defines an elongated aperture in communication with the elongated slot in one of the wall sides.

The hinge incorporated in the invention includes pivotally interconnected first and second hinge members, the first hinge member being attached to the door.

Mechanical fastener means extends into the recess and through the elongated slot defined by the cabinet wall through the elongated aperture of the elongated support plate for releasably securing the second hinge member to the cabinet wall at a selected location on the cabinet wall.

Other features, advantages, and objects of the present invention will become apparent with reference to the following description and accompanying drawings.

BEST MODE FOR CARRYING OUT THE INVENTION

Figure 1:
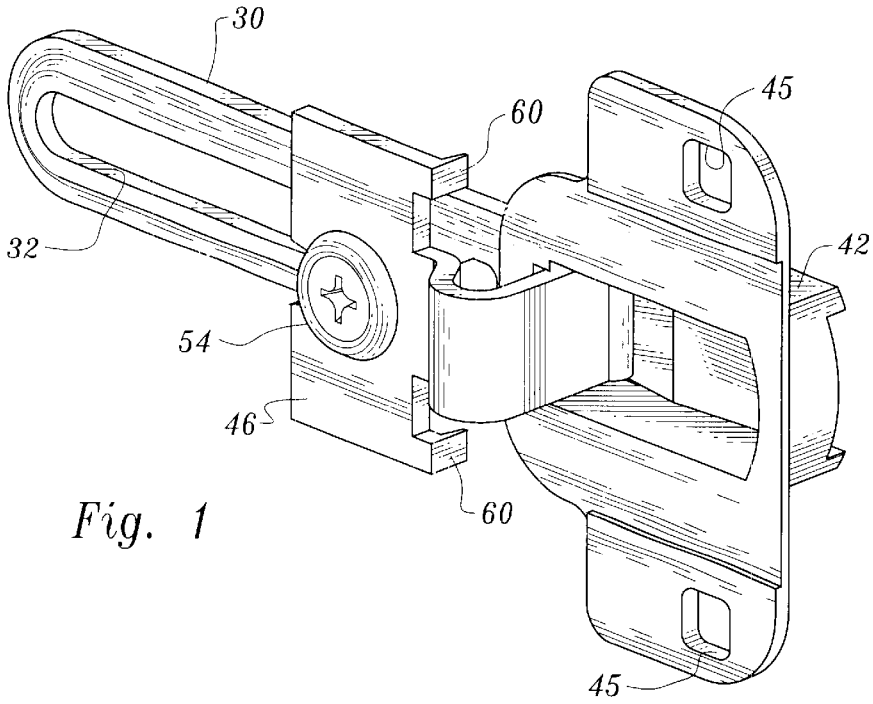
FIG. 1 is a frontal, perspective view showing a hinge, elongated support plate and mechanical fastener constructed in accordance with the teachings of the present invention.
Figure 2:
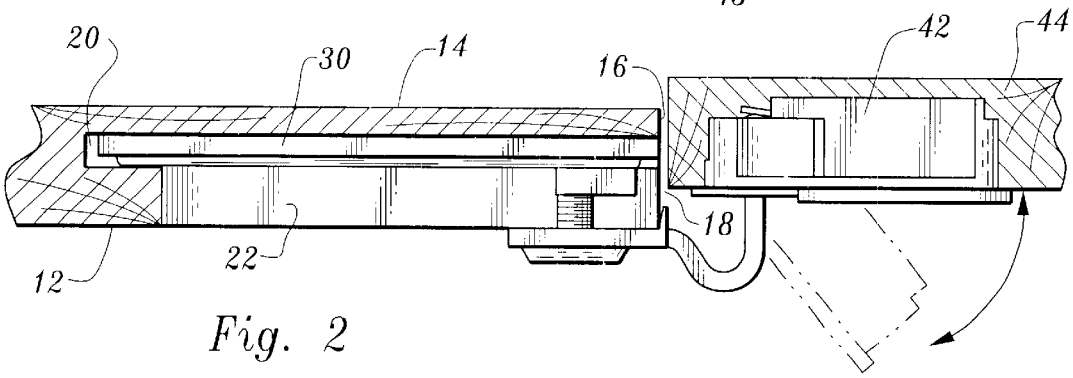
FIG. 2 illustrates the structure of FIG. 1 installed in place on a cabinet wall and holding a cabinet door, one of the hinge members being illustrated in two alternate positions.
Figure 3:
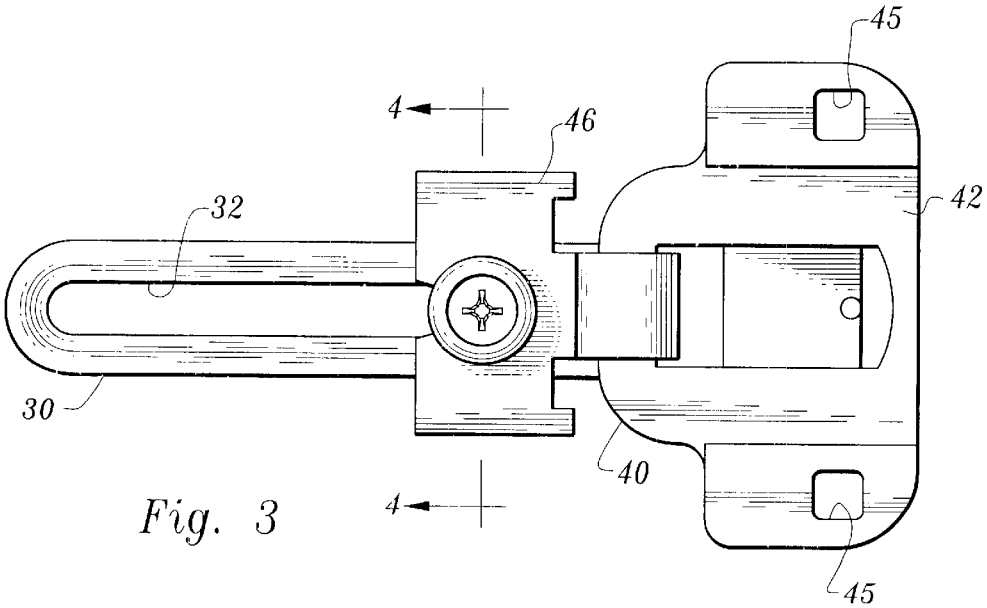
FIG. 3 is an elevational, side view of the apparatus of FIG. 1.
Figure 6:
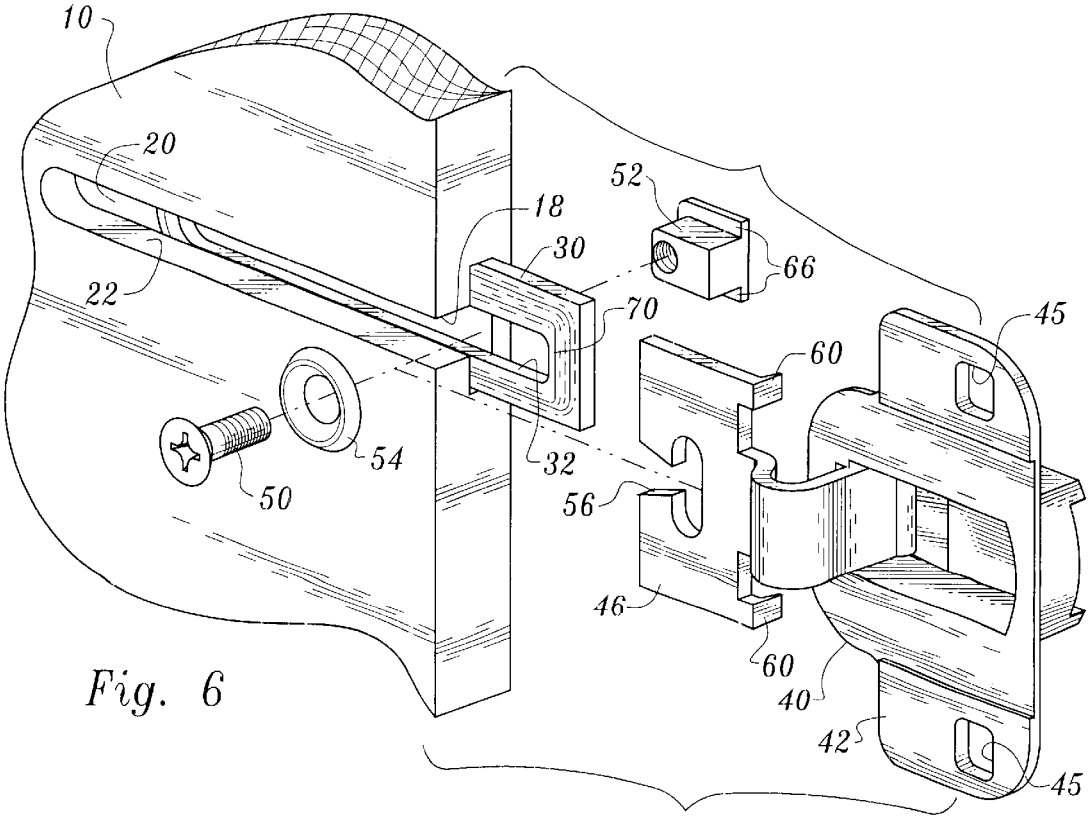
FIG. 6 is an exploded, perspective view illustrating a portion of a cabinet wall and components of the apparatus in the process of being secured thereto.

Referring now to FIGS. 2 and 6, a portion of a wall 10 of a cabinet of frameless construction is illustrated. The cabinet wall 10 may be constructed of any suitable material such as wood or particle board. As indicated above, the apparatus of the present invention provides hinge support strength even when a thin, relatively weak cabinet material is employed.

Cabinet wall 10 includes spaced wall sides 12, 14 and a wall front 16 extending between the spaced side walls.

Cabinet wall 10 defines an opening 18 at the wall front, an elongated recess 20 extending inwardly from the opening 18 into the cabinet wall between the wall sides and an elongated slot 22 in wall side 12 communicating with elongated recess 20.

It will be noted that the elongated slot has a vertical dimension less than the vertical dimension of the elongated recess and that the slot is located at an elevation below the uppermost extent of the elongated recess and above the lowermost extent of the elongated recess. As observed from the end (looking toward wall front 16), the elongated recess 20 and elongated slot 22 have a T-shaped configuration. The recess and slot may be suitably formed by employing conventional routing techniques.

The hinge system construction employed with cabinet wall 10 includes a double-ended, elongated support plate 30 defining an elongated aperture 32. FIG. 2 shows the support plate 30 located within the elongated recess 20, with one of the ends of the support plate disposed at opening 18 at the wall front of the cabinet wall and the other end located a considerable distance inwardly of the opening. A suitable distance may, for example, be 2 to 3 inches from the wall front for certain cabinet materials and thicknesses. The important issue to bear in mind is to employ a support plate of sufficient size to distribute forces from the hinge over a relatively substantial area of the cabinet wall extending inwardly of the opening. In the arrangement disclosed, for example, the length of the support plate may be 3 inches and the length of the elongated recess slightly more so that the support plate can be fully accommodated in the cabinet wall. When the support plate is so installed, the elongated aperture 32 thereof is in communication with the elongated slot 22.

Figure 4:
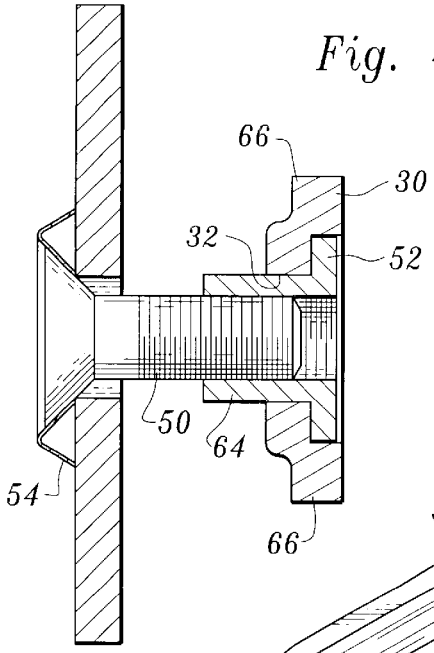
FIG. 4 is an enlarged, cross-sectional view taken along the line 4—4 of FIG. 3.
Figure 5:
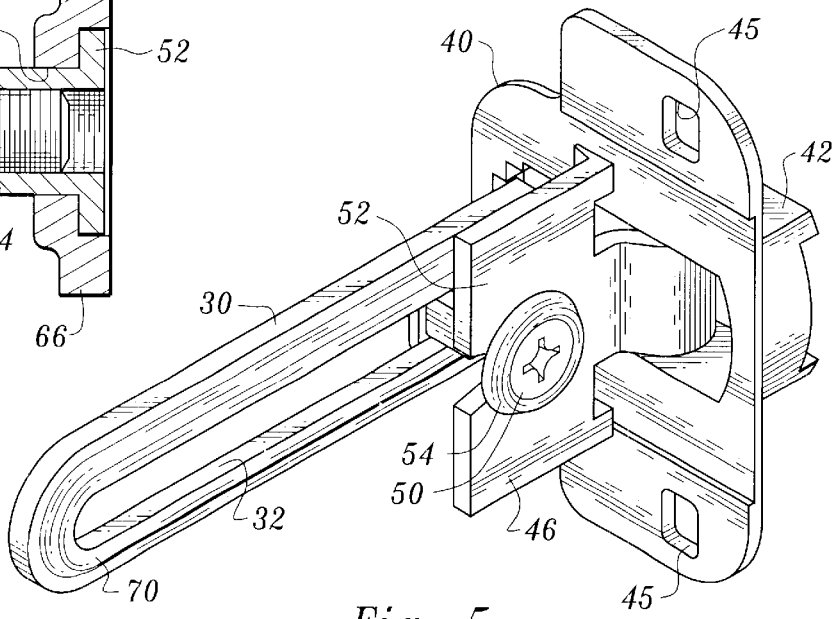
FIG. 5 is another perspective view of the apparatus, showing the apparatus from the rear end thereof.

Another component of the apparatus is the hinge 40 including a first hinge member 42 attached to the cabinet door 44 (a portion of which is shown in FIG. 4) and a second hinge member 46. The hinge disclosed herein is merely representative of the types of hinges to which the invention can be applied.

The first hinge member 42 is of standard construction, being a cup-type hinge member positioned in and secured to the cabinet door by mechanical fasteners such as screws (not shown). The mechanical fasteners are inserted into rectangular openings or holes 45 (squares with rounded corners in the disclosed embodiment) which are larger than the mechanical fastener shafts to allow adjustment of the hinge relative to the cabinet door. Second hinge member 46 is in the form of a hinge plate positioned over wall side 12. FIG. 2 shows the action of the hinge, the solid line representation of first hinge member 42 representing the door in closed position and the phantom line representation showing the first hinge member 42 (and accompanying door, not shown) being pivoted to open position as shown by the double-headed arrow.

When the hinge is fully installed as shown in FIG. 2, a mechanical fastener in the form of threaded bolt 50 and a securement member 52 threadedly engaged with the bolt are employed to clampingly engage the segment of the cabinet wall surrounding elongated slot 22 between elongated support plate 30 and second hinge member 46. A washer 54 is deployed between the bolt head and the second hinge member 46. A washer need not be employed if desired.

Prior to tightening of the bolt and securement member, the bolt is positioned in an enlarged hinge plate opening 56 which is larger than the diameter of the shaft of the bolt and extends to the distal end of the second hinge member. The relative positioning of the bolt and second hinge member may be changed by moving the second hinge member up and down in the enlarged opening 56. Abutments 60 on hinge plate 46 engage wall front 16 to maintain correct positioning of the hinge plate relative to the cabinet wall.

Prior to their tightening, the bolt and securement member may be slid along the elongated support plate for attaining the desired placement of the system components. The securement member 52 includes a threaded body 64 and flanges 66 extending outwardly from the threaded body. The threaded body 64 is positioned in elongated aperture 32 of the support plate and includes upper and lower contact surfaces which contact the plate to resist rotation of the securement member threaded body relative to the support plate. The support plate has an area of reduced width adjacent to and extending along the elongated aperture accommodating the flanges 66. Thus, the securement member does not project outwardly from that side of the elongated support plate, allowing the securement member to be positioned in the recess 20.

A projecting rib 70 is formed on the elongated support plate to clampingly engage the portion of the cabinet wall immediately surrounding elongated slot 22.

It will be appreciated that the elongated support plate distributes forces over a considerable area of the cabinet wall, being a major contributing factor in the ability of the cabinet wall to resist outside forces applied to the hinge which might otherwise result in cabinet failure using conventional hinge constructions.

What is claimed is:

1. In combination:

a cabinet of frameless construction including a cabinet wall and a cabinet door, said cabinet wall including spaced wall sides and a wall front extending between said spaced wall sides, said cabinet wall defining an opening at said wall front, an elongated recess extending inwardly from said opening into said cabinet wall between said wall sides and an elongated slot in one of said wall sides communicating with said elongated recess, said elongated slot having a vertical dimension less than the vertical dimension of said elongated recess and located at an elevation below the uppermost extent of said elongated recess and above the lowermost extent of said elongated recess;

a double-ended, elongated support plate located within said elongated recess with one of the ends of the elongated support plate disposed at or closely adjacent to the opening at the wall front of the cabinet wall and the other end located a predetermined distance inwardly of said opening, said elongated support plate defining an elongated aperture in communication within the elongated slot in one of the wall sides and for distributing forces over a predetermined area of said cabinet wall;

a hinge including pivotally interconnected first and second hinge members, said first hinge member being attached to said door; and mechanical fastener means extending into said recess and through the elongated slot defined by s aid cabinet wall and through the elongated aperture of said elongated support plate for releasably securing said second hinge member to said cabinet wall at a selected location on said cabinet wall, said mechanical fastener means including a bolt extending through said second hinge member and through said elongated slot and a securement member threadedly engaged with said bolt and disposed in said elongated recess, said mechanical fastener means being slidably movable relative to said elongated support plate in said elongated aperture when said bolt and said securement member are loosened, and said bolt and securement member when tightened urging said second hinge member and said elongated support plate toward one another to clampingly engage therebetween a portion of said cabinet wall.

2. The combination according to claim 1 wherein said securement member includes an internally threaded securement member threaded body positioned in said elongated aperture and flanges extending outwardly from said securement member threaded body for engaging a side of said elongated support plate.

3. The combination according to claim 2 wherein said securement member threaded body includes contact surfaces for contacting said elongated support plate at said elongated aperture to resist rotation of said securement member threaded body relative to said elongated support plate.

4. The combination according to claim 2 wherein said elongated support plate has an area of reduced width adjacent to and extending along said elongated aperture accommodating the flanges of said securement member.

5. The combination according to claim 1 wherein said elongated support plate has a projection formed on a side thereof clampingly engaging said portion of said cabinet wall.

6. The combination according to claim 1 wherein said second hinge member includes a hinge plate positioned over the cabinet wall side in which said elongated slot is formed, said hinge plate including a hinge plate opening receiving said bolt.

7. The combination according to claim 6 wherein said hinge plate opening is larger than the diameter of the shaft of said bolt.

8. The combination according to claim 7 wherein said hinge plate has a distal end and wherein said hinge plate opening extends to said distal end.

9. The combination according to claim 8 additionally including at least one abutment projecting from said hinge plate at a location spaced from said opening, said at least one abutment engaging the wall front of said cabinet wall.

10. The combination according to claim 1 wherein said elongated support plate is at least 2 inches long.

11. The combination according to claim 1 wherein enlarged openings are formed in said first hinge member for loosely accommodating a mechanical fastener to allow adjustment between the first hinge member and the door.

12. Apparatus for use with a frameless cabinet and for hingedly connecting a cabinet door to a cabinet wall of a frameless cabinet including spaced wall sides and a wall front extending between said spaced wall sides and defining an opening at said wall front, an elongated recess extending inwardly from said opening into said cabinet wall between said wall sides and an elongated slot in one of the wall sides communicating with the elongated recess, said elongated slot having a vertical dimension less than the vertical dimension of said elongated recess and located at an elevation below the uppermost extent of said elongated recess and above the lowermost extent of said elongated recess, said apparatus comprising, in combination:

a double-ended, elongated support plate for positioning within the elongated recess with one of the ends of the elongated support plate disposed at or closely adjacent to the opening at the wall front of the cabinet wall and the other end located a predetermined distance inwardly of said opening when the elongated support plate is in said elongated recess, said elongated support plate defining an elongated aperture in communication with the elongated slot in one of the wall sides when said elongated support plate is in the elongated recess for distributing forces over a predetermined area of the cabinet wall when the elongated support plate is in the elongated recess;

a hinge including pivotally interconnected first and second hinge members, said first hinge member for attachment to the cabinet door; and mechanical fastener means for extending into said recess and through the elongate slot defined by the cabinet wall and through the elongated aperture of said elongated support plate when the elongated support plate is in the elongated recess for releasably securing said second hinge member to the cabinet wall at a selected location on the cabinet wall, said mechanical fastener means including a bolt extending through said second hinge member and for extending through the elongated slot and a securement member threadedly engaged with said bolt for positioning in the elongated recess, said mechanical fastener means being slidably movable relative to said elongated support plate in said elongated aperture when said bolt and said securement member are loosened, said bolt and securement member when tightened urging said second hinge member and said elongated support plate toward one another for clampingly engaging therebetween a portion of the cabinet wall.

13. The apparatus according to claim 12 wherein said support plate is at least two inches long.

14. The apparatus according to claim 12 wherein enlarged openings are formed in said first hinge member for loosely accommodating a mechanical fastener to allow adjustment between the first hinge member and said door.

* * * * *